US005411327A

United States Patent [19]

Norton

[11] Patent Number: 5,411,327

[45] Date of Patent: May 2, 1995

[54] LATERAL FILE ANTI-TILT MECHANISM WITH PIVOTAL ACTIVATOR RAIL

[75] Inventor: Allen Norton, Salamanca, N.Y.

[73] Assignee: Signore Incorporated, Ellicottville, N.Y.

[21] Appl. No.: 177,967

[22] Filed: Jan. 6, 1994

[51] Int. Cl.[6] ..... E05C 7/06; E05B 65/46; A47B 88/00

[52] U.S. Cl. ..... 312/221; 312/216; 312/220

[58] Field of Search ..... 312/216, 220, 221

[56] References Cited

U.S. PATENT DOCUMENTS

| | | | |
|---|---|---|---|
| 3,323,849 | 6/1967 | Stark | 312/221 |
| 3,969,008 | 7/1976 | Pergler | 312/221 |
| 4,272,138 | 6/1981 | Stark | 312/221 |
| 4,441,767 | 4/1984 | Stark | 312/216 |
| 4,480,883 | 11/1984 | Young | 312/216 X |
| 4,624,511 | 11/1986 | Oehme | 312/216 X |
| 4,732,433 | 3/1988 | Bruneau | 312/220 X |

*Primary Examiner*—James R. Brittain
*Assistant Examiner*—Robert J. Sandy
*Attorney, Agent, or Firm*—Bean, Kauffman & Spencer

[57] ABSTRACT

A file cabinet having vertically arranged horizontally movable drawers and an anti-tip lock mechanism that permits movement of a single drawer from its closed to its opened position while simultaneously locking the remaining unopened drawers against movement from their closed to their opened positions.

2 Claims, 1 Drawing Sheet

LATERAL FILE ANTI-TILT MECHANISM WITH PIVOTAL ACTIVATOR RAIL

BACKGROUND OF THE INVENTION

Prior commonly owned U.S. Pat. Nos. 4,272,138 and 4,441,767 to Stark disclose file cabinet drawer anti-tip lock devices, which prevent more than one drawer in a vertical stack of drawers from being opened at a given time, whether opening of a second drawer is attempted simultaneously with or subsequent to the opening of a first drawer. The anti-tip mechanism described therein utilizes a segmented, vertically extending lock bar composed of snubber elements arranged in end-to-end abutment along a side of the cabinet housing, and a plurality of horizontally disposed activator rails each carried by a different drawer and arranged upon opening of an associated drawer to move between the ends of a pair of adjacent snubber elements and effect vertical displacement of the snubber elements, whereby activator rails carried by other drawers are blocked from outward movement.

In the constructions disclosed by the above patents, the activator rails are required to be mounted for sliding movement relative to the drawers, as an incident to drawer opening and closing movements, in order to permit the activator rails to function for snubber element displacement purposes throughout the full range of drawer movements.

In a more recent development, employing snubber elements having a slightly different mode of operation, the activator rails comprise front parts non-movably fixed one to each of the drawers and rear parts slidably supported one by each drawer in horizontal alignment with associated front parts.

In these prior constructions, the slidable activator rails or rail parts have been objected to as creating undesired noise during drawer opening and closing movements.

SUMMARY OF THE INVENTION

The present invention generally relates to file cabinets and locking means for preventing more than one cabinet drawer from being opened at one time.

In accordance with the present invention, a file cabinet having a plurality of vertically arranged horizontally movable drawers is provided with an anti-tip mechanism generally including a lock bar extending vertically at a lateral side of the cabinet housing, and a plurality of activator rails carried one by each drawer and arranged to cooperate with the lock bar such that only one drawer may be opened at a given time.

The lock bar preferably comprises a segmented column of elongated snubber elements vertically aligned in end-to-end abutment and mounted within a vertically extending channel in the cabinet housing in a manner which permits the snubber elements to be vertically displaced from a reference position into a locking position. Each drawer of the cabinet is equipped with an activator rail which is carried on a side of the drawer and arranged such that a leading or outer end thereof, which leads in the direction of drawer opening movement, is arranged for insertion between a pair of adjacent snubber elements upon opening of the drawer. Insertion of the activator rail of one drawer in this manner serves to move the snubber elements into a locking position wherein they are arranged to block activator rails of the other drawers from opening movement.

In accordance with the present invention, each activator rail includes a main portion, which is nonmovably fixed to a side of a drawer and serves to define the leading end of the activator rail, and a continuation portion, which is arranged adjacent a trailing end of an associated main portion and supported for pivotal movement about a transverse, horizontally disposed axis between an operable position, in which it is disposed in horizontal alignment with the main portion, and a vertically extending rest position.

When the drawers are closed, the snubber elements are disposed in their reference position and the continuation portions of the activator rails reside in their rest positions under the influence of gravity. As one of the drawers is opened, the leading end of the main portion of its activator rail inserts itself between a pair of adjacent snubber elements and thereafter vertically displaces one or all of the snubber elements, depending upon the construction and mode of operation of the lock bar, into a locking position. As the drawer approaches its fully extended or opened position, the continuation portion of its activator rail is moved between the adjacent snubber elements, and forced thereby to pivot upwardly into its operative position, wherein it is effective in restraining the snubber elements from movement from their locking position, during continued movement of the drawer into its fully extended position. As the fully extended drawer is returned to its closed position, the continuation portion is first removed from between adjacent snubber elements and allowed to pivot downward into its rest position under the influence of gravity, and thereafter the leading end of the main portion is withdrawn from between the adjacent snubber elements to allow same to return to their reference position. By permitting the continuation portion to assume a vertically disposed rest position when the drawer is closed, the necessary spacing between the rear of the drawer and rear wall of the cabinet is reduced.

BRIEF DESCRIPTION OF THE DRAWING

The nature and mode of operation of the present invention will now be more fully described in the following detailed description taken with the accompanying drawing wherein.

DETAILED DESCRIPTION

Figure 1:
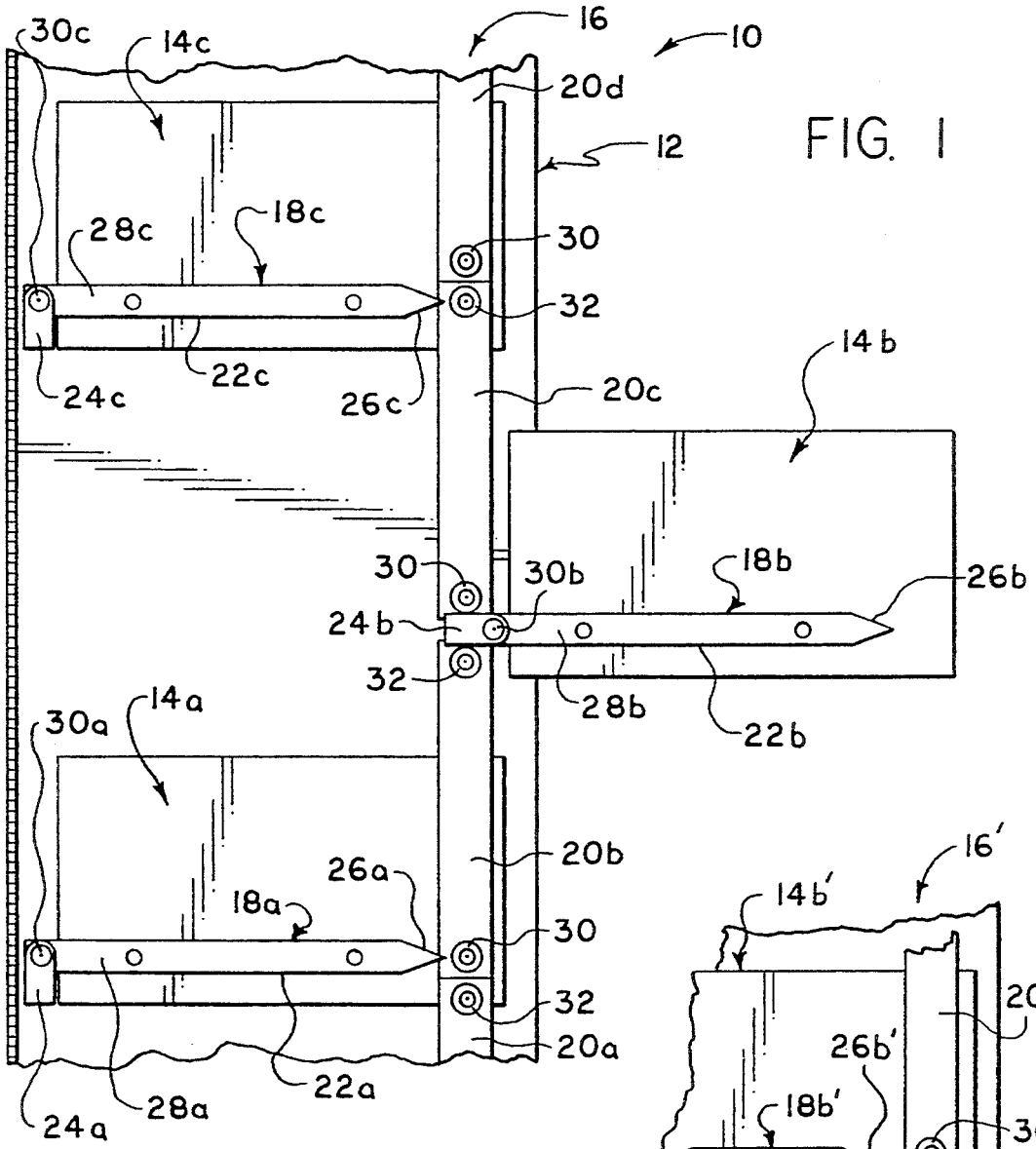
FIG. 1 is a simplified side elevation of an improved cabinet showing one drawer extended, so as to illustrate the functioning of the anti-tip mechanism of the present invention.

FIG. 1 generally illustrates a cabinet 10 shown as including a cabinet housing or case 12 and two or more vertically spaced and horizontally movable components, such as drawers, shelves, or the like, individually designated as 14*a*, 14*b* and 14*c* to facilitate the following description. In the context of a file cabinet, these drawers may be roll-out shelves or drawers, suitably supported by conventional extension slide or roller devices, not shown, for horizontally extending movement outwardly and inwardly of cabinet housing 12 between an inner or retracted position shown for example in the case of components 14*a* and 14*c* and an outer or extended position shown for example in the case of component 14*b*.

Cabinet 10 is provided with an anti-tip mechanism generally comprising a segmented lock bar 16 extending vertically adjacent a lateral side of cabinet housing 12, and a plurality of activator rails carried one by each drawer and generally designated as 18*a*, 18*b* and 18*c*. The activator rails are arranged to cooperate with lock bar 16 such that only one drawer may be moved into open position at a given time.

Lock bar 16 comprises a segmented column consisting of a plurality of longitudinally extending snubber elements shown for example at 20*a*–20*d*, which are axially aligned and normally reside in end-to-end abutting relationship. Lock bar 16 is preferably mounted within a vertically extending channel in cabinet housing 12 in a manner which permits the vertically extending snubber elements 20*a*–20*d* to be vertically or axially displaced yet horizontally restrained. The entire column or lock bar 16 is biased to positively assume a reference position, either by gravity or mechanical biasing means (not shown), depending on the construction and mode of operation of the lock bar.

Activator rails 18*a*–18*c* include main portions 22*a*–22*c*, which are rigidly fixed to and extend horizontally of drawers 14*a*–14*c*; and continuation portions 24*a*–24*c* associated one with each of the main portions. The main portions are considered as having leading and trailing end portions 26*a*–26*c* and 28*a*–28*c*, respectively, arranged in the direction of movement of the drawers horizontally outwardly of cabinet housing 12. In accordance with the present invention, continuation portions 24*a*–24*c* are supported by pivot pins 30*a*–30*c* for pivotal movement adjacent trailing end portions 28*a*–28*c* between a downwardly extending rest position, shown for the case of portions 24*a* and 24*c*, and an operative position arranged in horizontal alignment with their associated main portion, as shown for the case of portion 24*b*. Preferably, pivot pins 30*a*–30*c* connect continuation portions 24*a*–24*c* directly to trailing end portions 28*a*–28*c*.

In the lock bar construction generally shown in FIG. 1, each of snubber elements 20*a*–20*d* is supported for vertical movement and biased into a reference position, wherein the pairs of adjacent ends of the snubber elements are horizontally aligned with the leading ends of the main portions of the activator rails. Preferably, leading ends 26*a*–26*c* are wedge-shaped and the adjacent ends of the snubber elements are fitted with upper and lower roller elements 30 and 32, respectively, arranged to be engaged by such leading ends for purposes of moving the snubber elements into a locking position.

In operation of the form of the invention shown in FIG. 1, drawers 14*a*–14*c* would normally be first disposed in a closed position, thereby permitting suitable bias, not shown, to maintain snubber elements 20*a*–20*d* in a reference position characterized in that the abutting ends of adjacent pairs of the snubber elements are disposed in horizontal alignment with the sharp leading ends 26*a*–26*c* of activator rails 18*a*–18*c*. When one of the drawers is moved towards open position, such as for example drawer 14b as shown in FIG. 1, leading end 26*b* of main portion 22*b* of its activator rail 18*b* is inserted between upper and lower rollers 32 and 30 of snubber elements 20*b* and 20*c*, respectively, with the result that such snubber elements are forced apart with snubber elements 20*c* and 20*d* moving upwardly and snubber elements 20*a* and 20*b* moving downwardly from their initial reference position. As a result, roller 30 of snubber element 20*b* is moved into alignment with activator rail 18*a* and roller 32 of snubber element 20*c* is moved into alignment with activator rail 18*c*, thereby preventing opening movement of drawers 14*a* and 14*c*. As opening movement of drawer 14*b* continues, continuation portion 24*b* is eventually brought into engagement with roller 32 of snubber element 20*b* with the result that portion 24*b* is forced to pivot upwardly from its initial downwardly extending rest position into its illustrated operative position, wherein it is disposed in horizontal alignment with main portion 22*b* and serves to maintain the snubber elements in their locking position during the final portion of movement of drawer 14*b* into its illustrated fully open position. Thus, it will be understood that main portion 22*b* and continuation portion 24*b* cooperate, while inserted between the ends of snubber elements 20*b* and 20*c*, to maintain such snubber elements, as well as snubber elements 20*a* and 20*d*, in their illustrated locking positions throughout the range of movement of drawer 14*b* outwardly and inwardly of cabinet housing 12. In the event that a user should attempt to open two drawers, such as drawers 14*a* and 14*b*, at one time, main portions 22*a* and 22*b* of activator rails 18*a* and 18*b* would be brought into simultaneous engagement with rollers 30 and 32 of snubber element 20*b* whose column or buckling strength would by design be sufficient to prevent converging movement of such rollers. As a result, drawers 14*a* and 14*b* would be barred against simultaneous opening movements.

Figure 2:
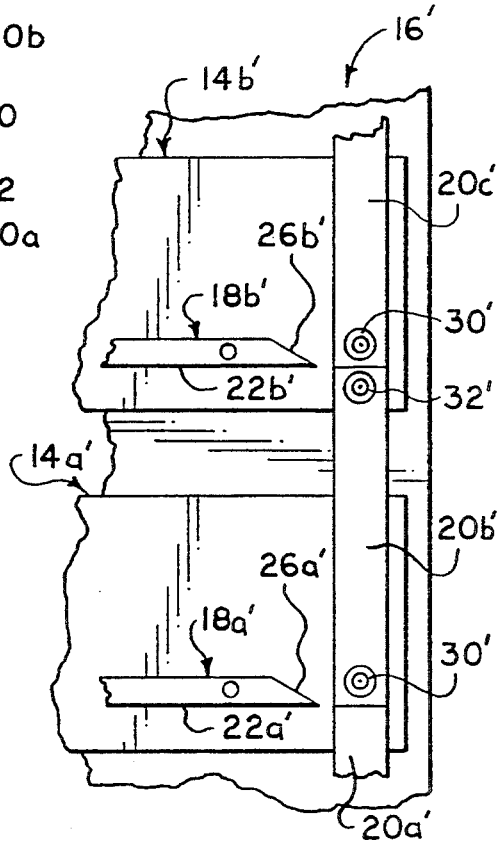
FIG. 2 is a fragmentary view similar to FIG. 1, but showing an alternative construction.

Reference is now made to FIG. 2, wherein an alternative construction is shown with like primed numerals being employed to designate parts similar to those described in connection with FIG. 1. More specifically, in this construction, lock bar 16' differs from lock bar 16 in that the lowermost snubber element 20*a'* is constrained against downwardly directed movement and gravity may be employed to normally maintain upper snubber elements 20*b'*, 20*c'*, etc. in their illustrated reference position determined by end abutment of snubber elements 20*a'*, 20*b'* and 20*b'* and 20*c'*, and so forth. Further, in this construction, the shape of leading ends 26*a'*–26*b'* of main portions 22*a'*–22*b'* of the activator rails 18*a*'–18*b'* differs from that of leading ends 26*a*–26*b* in that they include only one cam surface arranged to underengage rollers 30' with the lower surface of main portion 22*b'*, etc. arranged to lie essentially tangent with rollers 32' when snubber elements 20*b'*, 20*c'* etc. are in their reference position. With this construction, if drawer 14*a'* were to be moved into open position, leading end 26*a'* would cammingly engage with roller 30' of snubber element 20*b'* and effect lifting of all of the movable snubber elements of lock bar 16' into locking position, wherein their rollers 32' are arranged for blocking engagement with the activator rails of the remaining drawers. Further, as by way of example, if another drawer, such as drawer 14*b'* were to be moved into open position, the leading end of its activator rail would cammingly engage with roller 30' of snubber element 20*c'* in order to effect upward movement of such snubber element and the snubber elements resting thereon in the manner described above for purposes of blocking opening movement of drawers disposed above drawer 14*b'*. However, it will be noted that unlike the construction of FIG. 1, main portion 22*b'* of activator rail 18*b'* does not engage with roller 32' of snubber element 20*b'* in order to effect downward movement thereof. Rather, main portion 22*b*′ merely moves into a position for overlying engagement with roller 32′ of snubber element 20*b*′ in order to prevent upwardly directed movement of snubber element 20*b* sufficiently to remove roller 30′ of such snubber element from opening movement blocking engagement with activator rail 18*a*′ of drawer 14*a*′. As with the construction of FIG. 1, continuation portions, not shown, are pivotally connected to main portions 22*a*′ and 22*b*′ and cooperate therewith to maintain the snubber elements of lock bar 16′ in their locking positions throughout the range of opening movements of the cabinet drawers.

What is claimed is:

1. In a cabinet of the type having at least two vertically spaced components mounted by the cabinet for horizontally extending movement outwardly and inwardly thereof and an anti-tip mechanism, wherein said anti-tip mechanism includes a vertically extending segmented locking bar having vertically aligned, snubber elements tending to reside in a reference position with adjacent ones of said snubber elements being disposed in end-to-end abutment and a plurality of activator rail means carried one by each of said components, each of said activator rail means having a leading end portion arranged in the direction of said movement of said component outwardly of said cabinet, said leading end portion of each said activator rail means being arranged for insertion between ends of an adjacent pair of said snubber elements when in said reference position for purposes of moving same into a locking position for preventing more than one of said components from being moved outwardly of said cabinet at any one time, the improvement wherein each of said activator rail means comprises in combination:

a main portion non-movably fixed to said component on which same is mounted to extend horizontally thereof, said main portion defining said leading end portion and a trailing end portion in the direction of movement of said component outwardly of said cabinet; and a continuation portion supported for vertical pivotal movement adjacent said trailing end portion between a downwardly extending rest position and an operative position arranged in horizontal alignment with said main portion, said main portion and said continuation portion cooperating while inserted between said ends of an adjacent pair of said snubber elements to maintain said snubber elements in said locking position throughout the range of movement of said one of said components outwardly and inwardly of said cabinet.

2. The improvement according to claim 1, wherein said continuation portion is pivotally supported by said trailing end portion.

* * * * *